US007083424B2

(12) United States Patent
Motohashi

(10) Patent No.: US 7,083,424 B2
(45) Date of Patent: Aug. 1, 2006

(54) SOCKET FOR ELECTRONIC PART

(75) Inventor: Sentaro Motohashi, Yokohama (JP)

(73) Assignee: Otax Co., Ltd., Yokohama (JP)

( * ) Notice: Subject to any disclaimer, the term of this patent is extended or adjusted under 35 U.S.C. 154(b) by 0 days.

(21) Appl. No.: 10/862,357

(22) Filed: Jun. 8, 2004

(65) Prior Publication Data

US 2005/0020117 A1 Jan. 27, 2005

(30) Foreign Application Priority Data

Jul. 23, 2003 (JP) ..... 2003-200634

(51) Int. Cl.
*H01R 12/00* (2006.01)

(52) U.S. Cl. ..... 439/66

(58) Field of Classification Search ..... 439/66, 439/733.1, 591
See application file for complete search history.

(56) References Cited

U.S. PATENT DOCUMENTS 4,806,104 A * 2/1989 Cabourne ..... 439/66
4,998,886 A * 3/1991 Werner ..... 439/66
5,395,252 A * 3/1995 White ..... 439/66
5,800,184 A * 9/1998 Lopergolo et al. ..... 439/66
6,135,783 A * 10/2000 Rathburn ..... 439/66
6,386,889 B1 * 5/2002 Bishop ..... 439/66
6,811,407 B1 * 11/2004 Watanabe ..... 439/66

* cited by examiner

*Primary Examiner*—Briggitte R. Hammond
(74) *Attorney, Agent, or Firm*—Bacon & Thomas, PLLC

(57) ABSTRACT

In a connector board (socket) for an electronic component, each electrode member is a leaf spring formed by bending a conductive plate into a substantially U-shape with an opening facing substantially parallel to a surface of the connector board. A first contact is unitary with one free end of the leaf spring and is held in electrical contact with a corresponding terminal of electronic component, and a second contact is unitary with the other free end of the leaf spring and is held in electrical contact with a corresponding terminal of a printed circuit board. The leaf spring includes a first leg which extends substantially in parallel with a surface of the connector board, a coupling portion which is unitary with the first leg, and a second leg which is unitary with the coupling portion so as to oppose the first leg and which extends obliquely toward a surface of the connector board. Engagement elements are seated within grooves provided in partition walls and are formed unitarily with the coupling portion.

11 Claims, 14 Drawing Sheets

SOCKET FOR ELECTRONIC PART

BACKGROUND OF THE INVENTION

1. Field of the Invention

The present invention relates to a connector board for connecting an electronic component to a printed circuit board. More particularly, it relates to a connector board (or "socket") which is so designed that, when the electronic component of a CPO, an MPU or the like is pushed against it, the electrode terminals of the electronic component and those of a printed circuit board can be electrically connected through electrode portions disposed in the connector board.

2. Description of the Related Art

One known type of connector board for an electronic component is so constructed that, when the electronic component is pushed against the connector board, the electrical contact between the electrode terminals of the electronic component and the electrode portions of the connector board is maintained, while the electrode portions of the connector board are connected to the electrode terminals of a printed circuit board (refer to, for example, U.S. Pat. No. 6,004,141).

With the connector board for the electronic component, a clamping member is coupled to one end edge portion of the socket body, and it is swung about in the coupled state, to thereby urge the electronic component onto the connector board. A hook which is mounted to the other end of the clamping member is engaged with an engaging portion of the connector board. Thus, the electronic component is fixed (mounted) on the connector board, and the electrical contact between the electrode terminals of the electronic component and the electrode portions of the connector board is maintained.

As shown in FIG. 15, each of the electrode portions of the connector board includes a sliding contact 10 which comes into contact with the corresponding electrode terminal of the electronic component, and a spring contact 20, which is the form of a leaf spring, lies in contact with the sliding contact 10. The sliding contact 10 and the spring contact 20 are arranged in opposition within the recess 40 of the connector board 30.

When the electronic component is pushed against the connector board 30, the contact point 50 between the sliding contact 10 and the spring contact 20 is slidably moved in a direction b, perpendicular to a pushing direction a. In turn, the degree of pressure of the contact between the sliding contact 10 and the spring contact 20 increases in proportion to the amount of movement of the sliding contact 10 owing to the resilience of the spring contact 20.

In a connector board thus constructed, electrical contact between the electrode terminals of the electronic component and the electrode portions of the connector board is not harmed by the attachment or detachment of the electronic component. Moreover, the electrode portions are comparatively simple in structure and are easy to fabricate.

However, such a connector board remains unsatisfactory for the reasons stated below. Since each electrode portion of the connector board has a so-called "two-piece contact structure", consisting of the sliding contact 10 and the spring contact 20, the contact point 50 between the sliding contact 10 and the spring contact 20 may unintentionally slide to make the contact pressure unstable, depending upon the state of the contact position between the two. Moreover, the contacts have complicated shapes and are in two parts, so that the workability and assembly of the contacts are difficult, and the cost thereof is comparatively high. Further, since the displacement of the spring contact 20 is within the connector board 30, the connector board 30 itself must be sufficiently thick to allow for the displacement of the spring contact 20.

SUMMARY OF THE INVENTION

The present invention has been made in order to eliminate such difficulties, and it has for its object provision of a connector board for electrically connecting electrode terminals of an electronic component with a printed circuit board which facilitates the assembly of the electrode terminals, which provides a stable contact resistance, which allows reduction in the thickness of a connector board and which is comparatively low in cost.

In order to accomplish the above object, the present invention provides a connector board including: an insulating plate having opposing surfaces extending in longitudinal and lateral dimensions and having recesses, each of the recesses being defined by opposing parallel side walls defining therebetween an opening at one of the opposing surfaces and extending from the opening toward the other opposing surface; and leaf spring electrode members mounted in the recesses, each leaf spring electrode member formed by bending a conductive plate material across its minor dimension (intermediate bend), into substantially a U-shape with first and second straight leg portions, and by bending it across its minor dimension adjacent both of its distal ends to form first and second distal contact sections extending from respective straight leg sections, outwardly of the insulating plate, beyond respective opposing surfaces of the insulating plate. Placement of a circuit board or electrical component against a surface of the insulating plate displaces the distal contact sections inwardly, into the recesses, against the spring forces of the leaf spring electrode member.

In a preferred embodiment, the first straight leg sections are in parallel with the opposing surfaces of the insulating plate and the second straight leg sections extend from the intermediate bend obliquely relative to the surfaces of the insulating plate.

Preferably, the length of the obliquely extending second straight leg sections of the leaf spring electrodes is longer than the length of the parallel extending first straight leg sections.

Preferably, the leaf spring electrode members include unitary engagement pieces extending from their sides toward the sidewalls of the recess and fitted in engagement with first engagement grooves which are provided in the sidewalls.

In another embodiment the leaf spring electrode member includes unitary shafts extending from its sides toward the sidewalls of the recess, and rotatably supported by bearings provided in the sidewalls.

In yet another embodiment, the electrode member includes unitary extension elements extending from its sides toward sidewalls of the recess, and engagement elements unitary with ends of the extension elements and extending in parallel with the sidewalls, with the engagement elements fitted within engagement grooves in the sidewalls.

According to the present invention, each electrode member has a simple, single-piece construction, so that the workability and assembly of the electrode member are sharply enhanced, and the cost thereof becomes comparatively low. Moreover, the electrical contact between each of the first distal contact sections and the corresponding electrode terminal of the electronic component (or a printed circuit board) is at an oblique angle so that the length of the leaf spring electrode member can be increased. In turn, even when the thickness of a connector board itself is small, each terminal of the electronic component and the corresponding terminal of the printed circuit board can be reliably brought into electrical contact, and a stable contact pressure can be attained.

BRIEF DESCRIPTION OF THE DRAWINGS

FIGS. 7A–7C are side views, in cross-section showing the deflection of the electrode members upon attaching the printed circuit board and the electronic component in the present invention, wherein FIG. 7A shows the state of the electrode members before the electronic component and the printed circuit board are mounted, FIG. 7B shows the state of the electrode members after attaching the printed circuit board, and FIG. 7C shows the state of the electrode members after attaching the electronic component;

FIGS. 8A–8E illustrate the mounting of the electronic component on the connector board of the present invention, wherein FIG. 8A shows the relationship between the electronic component and the connector board, FIG. 8B shows a cover in an almost closed state with turning of a hand lever, FIG. 8C shows the hand lever in a further turned position, FIG. 8D shows the cover fully closed with the electronic component fixed in place, and FIG. 8E is a perspective view of the state shown in FIG. 8D;

FIGS. 11A–11C are views illustrating deflection of the electrode members of the second embodiment in attaching the printed circuit board and the electronic component, wherein FIG. 11A shows the state of the electrode members before the electronic component and the printed circuit board are mounted, FIG. 11B shows the state of the electrode members after attaching the printed circuit board, and FIG. 11C shows the state of the electrode after mounting the electronic component;

FIGS. 14A–14C are side views, in cross-section, showing the deflection of the electrode members in attaching the printed circuit board and the electronic component in the third embodiment of the present invention, wherein FIG. 14A shows the state of the electrode members before mounting the electronic component and the printed circuit board, FIG. 14B shows the state of the electrode members after attaching the printed circuit board, and FIG. 14C shows the state of the electrode members after mounting the electronic component.

DESCRIPTION OF THE PREFERRED EMBODIMENTS

Now, preferred embodiments of a connector board (or "socket") for an electronic component according to the present invention will be described in detail with reference to the drawings.

Figure 1:
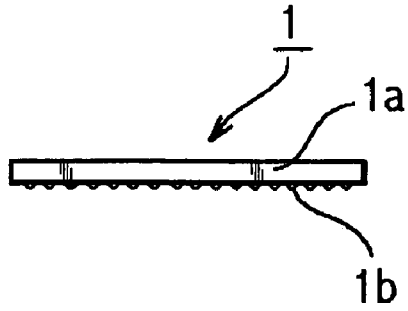
FIG. 1 is a side view showing an example of an electronic component.

Referring to FIG. 1, an electronic component 1 is shown in the form of, for example, a BGA (Ball Grid Array) and as including a housing 1*a*, and a large number of connection terminals 1*b* which are arrayed in a grid on the back surface of the housing 1*a*. The connection terminals 1*b* are spherical solder balls or the like.

Figure 2:
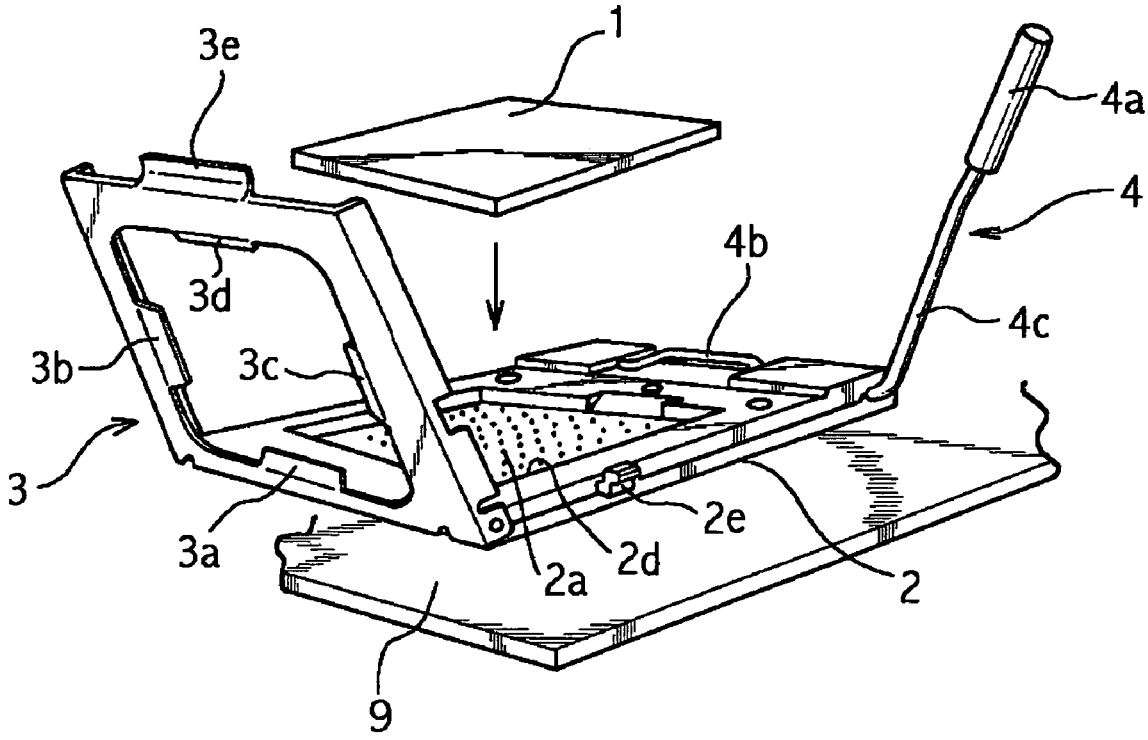
FIG. 2 is a perspective view of a connecting board in an embodiment of the present invention.

As shown in FIG. 2, a connector board according to the present invention includes a body portion 2 and electrode members 2*a* for connection with the electrode terminals 1*b* (refer to FIG. 1) of the electronic component 1, arranged substantially in the center of the principal surface thereof, a socket cover 3 which is pivotally mounted at one end edge of the connector board 2, and a lever 4 which is pivotally mounted on the other end edge side of the connector board 2.

Figure 3:
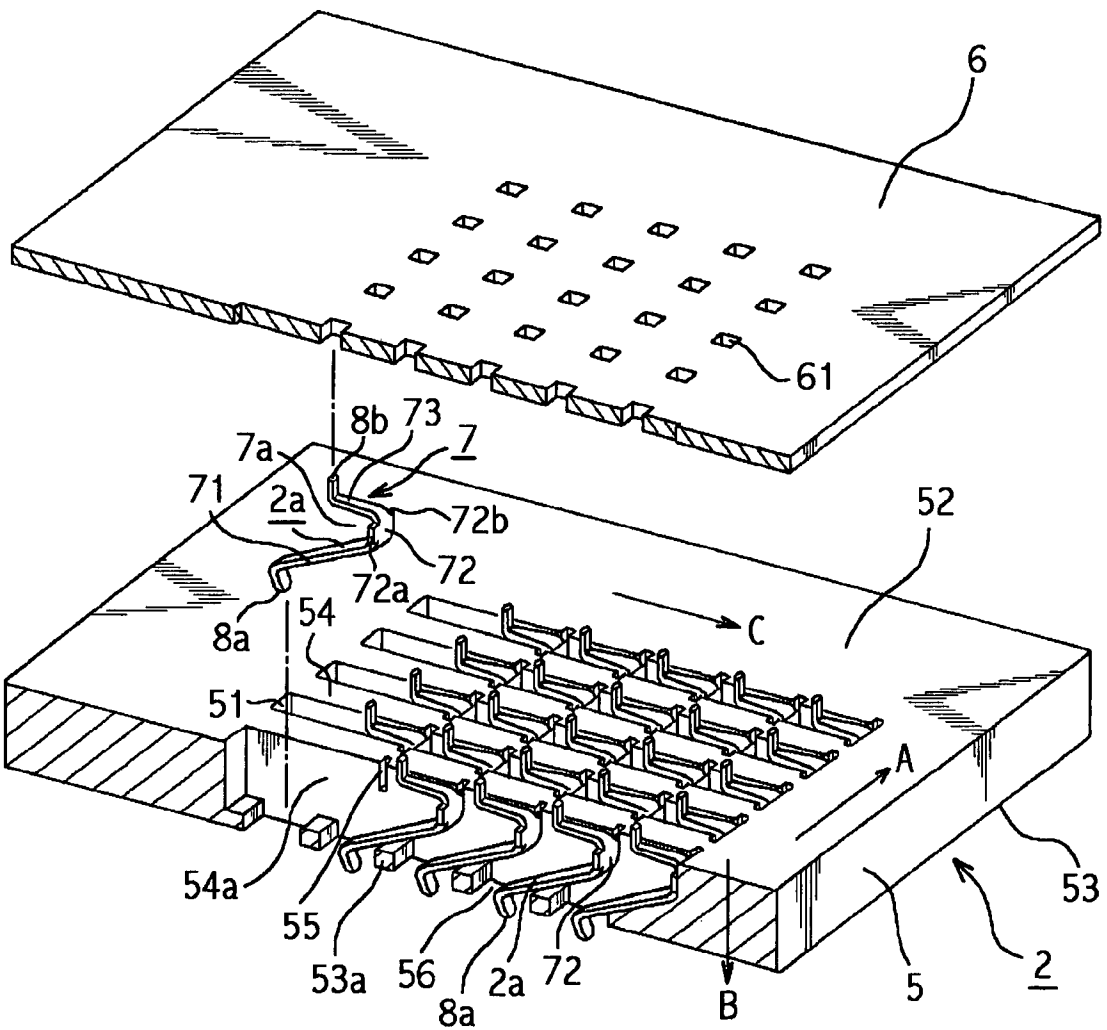
FIG. 3 is a perspective, exploded view showing the mounting of the electrode members in the recesses of a connector board in an embodiment of the present invention.

As shown in FIG. 3, the body portion 2 includes a rectangular flat plate 5, and a plate-like lining 6 which has the same shape as that bf the flat plate 5 and which is affixed onto the rear surface of the flat plate 5. The flat plate 5 and the lining 6 are formed of an insulating plastic material or the like.

The flat plate 5 includes a plurality of laterally elongated recesses 51 in its rear surface 52. The recesses 51 are arranged in so-called "columns" across the width (direction A) of the flat plate member 5 and with partition walls 54 therebetween. Here, each of the recesses 51 extends to a predetermined depth (equal to about ⅘ of the thickness of the flat plate member 5) in the thickness (direction B) of the flat plate member 5 from the rear surface 52 thereof.

The opposing sidewalls 54*a* of each recess 51 are provided with pairs of engagement grooves (hereinbelow, termed "first engagement grooves") 55 at predetermined intervals along the length (direction C) of the recess 51. Here, each of the first engagement grooves 55 extends over a predetermined length (a length equal to about ⅓ of the thickness of the flat plate member 5) in the thickness direction B of the flat plate member 5, from the rear surface 52 thereof.

A plurality of insertion holes (hereinafter, "first insertion holes") 56 are provided in the upper surface 53 of the flat plate member 5 corresponding to respective recesses 51, and are arranged at predetermined intervals along the length (direction C) of the recesses 51. Also, a plurality of insertion holes (hereinafter, "second insertion holes") 61 are provided in the lining member 6 corresponding to the respective recesses 51, and arranged at predetermined intervals along the length (direction C) of the recesses 51. Thus, the first insertion holes 56 are provided in a grid array at the upper surface of the body portion 2 so as to correspond to the electrode terminals 1*b* of the electronic component 1, while the second insertion holes 61 are provided in a grid array at the lower surface of the body portion 2 so as to correspond to the electrode terminals 9*a* (refer to FIG. 6) of a printed circuit board 9 (refer to FIG. 5). Thus, the first insertion holes 56 are in communication with the corresponding second insertion holes 61 through the respective recesses 51. Here, the dimension of each of the first insertion holes 56 in the C-direction is about 3–4 times the dimension of the second insertion hole 61 in the C-direction. The second insertion holes 61 are positioned substantially opposite the upper surface "hole surrounding portions" 53*a* of the flat plate member 5 which surround the first insertion holes 56, and the first engagement grooves 55 are provided near the second insertion holes 61 which are adjacent the left side as viewed in the figure.

Figure 4:
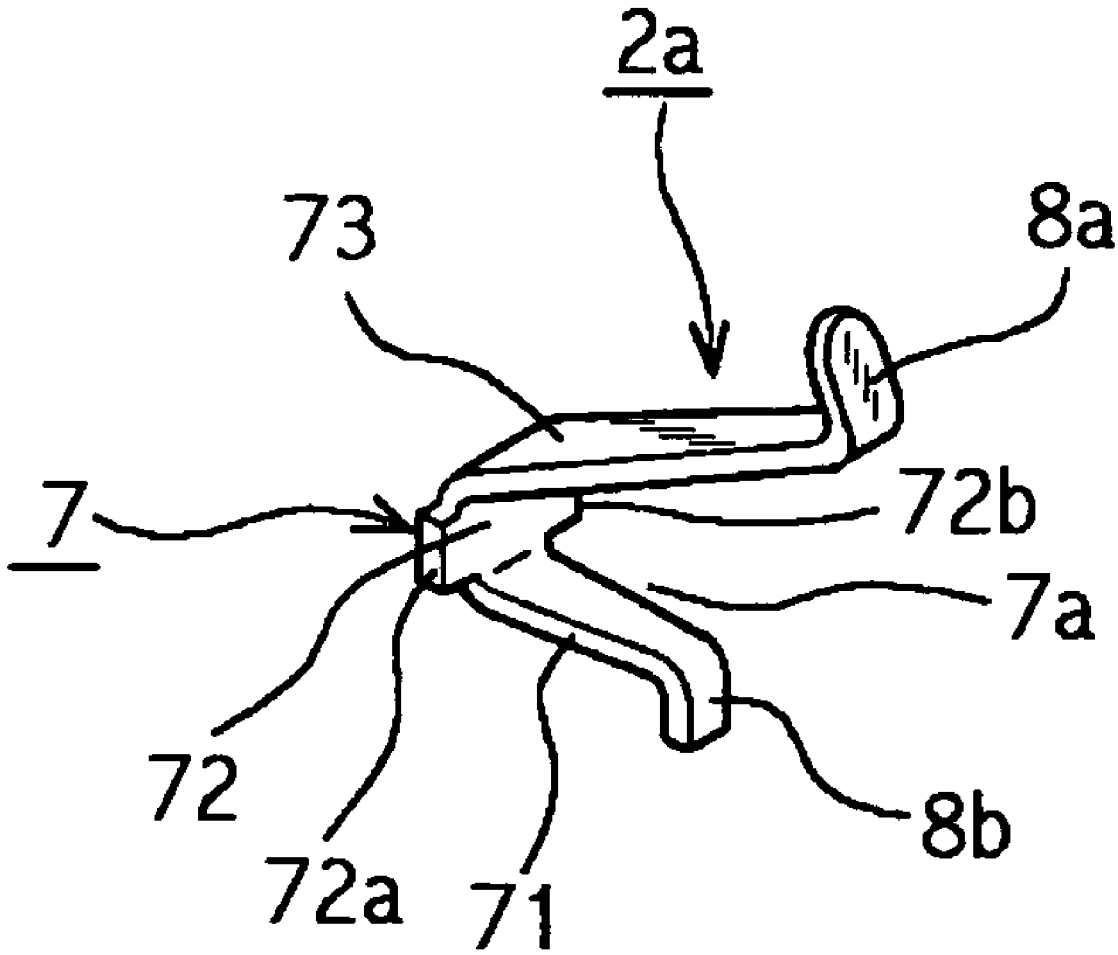
FIG. 4 is a perspective view of one embodiment of the electrode member in the present invention.

As shown in FIG. 4, each of electrode members 2*a* includes a leaf spring portion 7 which is a conductive plate member bent substantially in the shape of letter U at an intermediate bend or coupling portion 72 and which forms an opening 7*a* facing in the lengthwise direction C of the recess 51, substantially perpendicular to the thickness direction B (refer to FIG. 3) of the body portion 2. A first distal contact section 8*a* (hereinafter, "first contact") is formed by a bend across the minor dimension b adjacent one free (distal) end of the leaf spring electrode 7, and comes into electrical contact with the electrode terminal 1*b* of the electronic component 1. Likewise, a second distal contact section 8*b* (hereinafter "second contact"), which is unitary with the other free end of the leaf spring portion 7, is formed by another bend adjacent the other fee end and comes into electrical contact with the terminal 9*a* of the printed circuit board 9.

The leaf spring electrode member 7 includes a first straight leg section 71 which is arranged substantially in parallel with the surface of the printed circuit board 9, the coupling portion (intermediate bend) 72 which is unitary and connected with one end of the first straight leg 71 so as to extend in the thickness direction (B-direction) of the body portion 2, and an obliquely extending second straight leg portion 73 which is unitarily connected to the coupling portion 72 so as to oppose to the first straight leg portion 71 and to extend obliquely toward the electronic component 1. A pair of engagement pieces (hereinafter "first engagement pieces") 72*a* and 72*b*, which are received in the first engagement grooves 55, are unitarily connected to the sides of the coupling portion 72 so as to protrude toward the first engagement grooves 55. Here, the lateral width of the recess 51 (the "A" dimension) is substantially equal to or somewhat larger than the width of the leaf spring member 7. The A dimension between the opposing pair of first engagement grooves 55 is set to be substantially equal to or somewhat larger than the dimension between the opposing ends of the pair of first engagement pieces 72*a* and 72*b*. The groove width of each of the first engagement grooves 55 is set to be substantially equal to or somewhat larger than the plate thickness of the first engagement pieces 72*a* and 72*b*.

Subsequently, the distal end portion of the obliquely extending second straight leg 73, which constitutes the leaf spring portion 7, is bent toward the side of the electronic component 1 so as to be substantially perpendicular to the obliquely extending portion 73, and the distal end part of the parallel extending first straight leg portion 71 is bent toward the side of the printed circuit board 9 so as to be substantially perpendicular to the parallel extending first straight leg portion 71. Thus, the first contact 8*a*, which comes into electrical contact with the electrode terminal 1*b* of the electronic component 1, is formed at the distal end of the obliquely extending portion 73, and the second contact 8*b*, which comes into electrical contact with the electrode terminal 9*a* of the printed circuit board 9, is formed at the distal end of the parallel extending portion 71. The electrode member 2*a* as described above can be formed from one piece of plate material (length: 3 mm, width: 0.5 mm, and thickness: 0.06–0.08 mm) of, for example, phosphor bronze.

Figure 5:
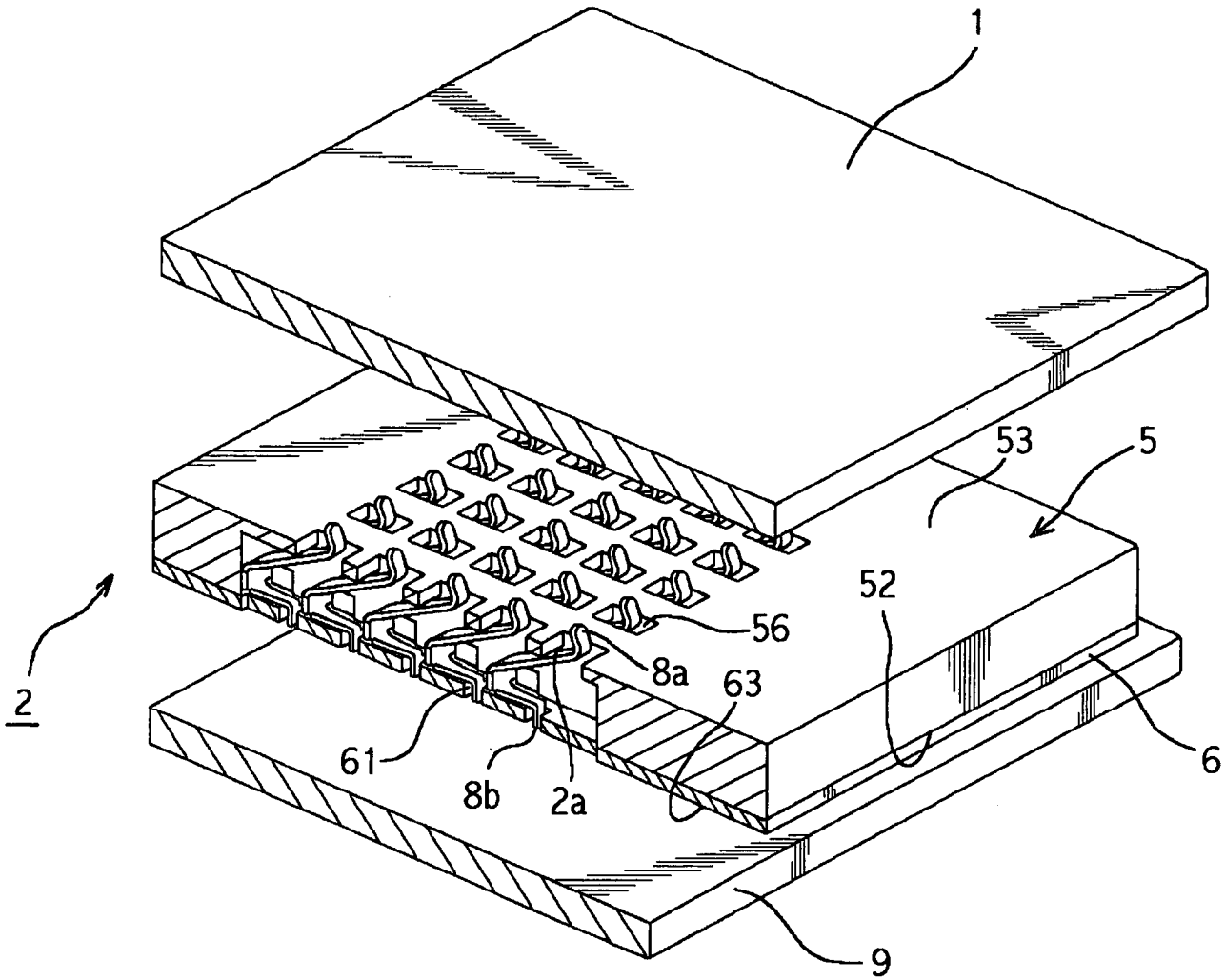
FIG. 5 is a perspective view showing the structural relationship between the electrodes, an electronic component and a printed circuit board in the present invention.

Next will be described a method for mounting the electrode members 2*a* in the corresponding recesses 51 of the body portion 2. First, the flat plate 5 is inverted as shown in FIG. 3, whereby the openings of the recesses 51, arranged as columns, face upwards. Subsequently, each of the electrode members 2*a* is inserted into a recess 51 with its opening 7*a* facing in the lengthwise direction C of the recess 51, that is, with the pair of first engagement pieces 72*a* and 72*b* perpendicular to the sides of the recess and fitted within a pair of first engagement grooves 55. Thus, as shown in FIG. 5, the distal end first contact 8*a* of each electrode member 2*a* extends through a corresponding first insertion hole 56, and protrudes about 0.3 mm beyond the upper surface 53 of the flat plate 5. Also, the distal end second contact 8*b* protrudes about 0.6 mm beyond the rear surface 52 of the flat plate 5.

In this way, the electrode members 2*a* are respectively received in the corresponding recesses 51 and are disposed in a grid array. Thereafter, the lining member 6 is adhered to the rear surface 52 of the flat member 5 so as to be united with this member 5. Thus, as shown in FIG. 5, the distal ends of the second contacts 8*b* of the electrode member 2*a* pass through the corresponding second insertion holes 61, respectively, so that they protrude about 0.25 mm beyond the rear surface 63 of the lining member 6.

Figure 6:
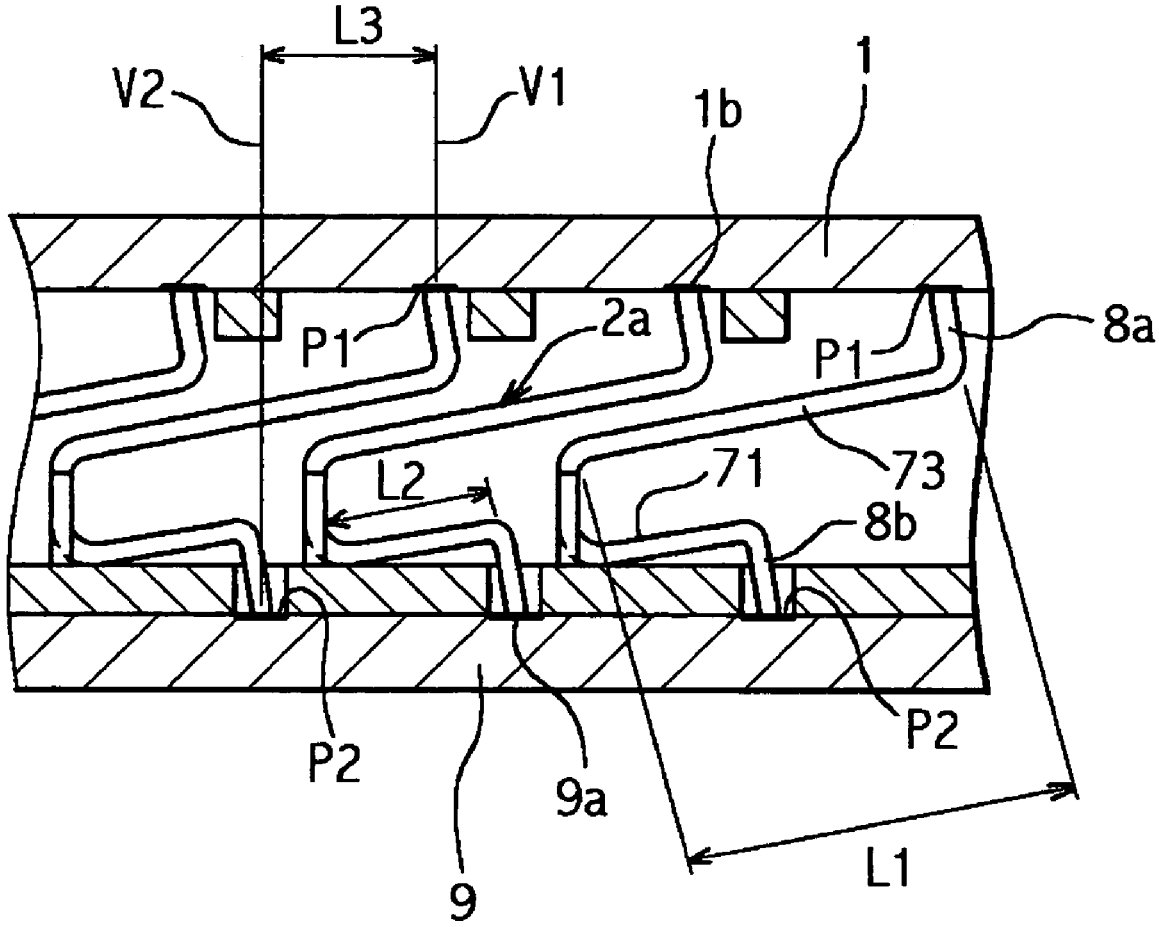
FIG. 6 is a side view, in cross-section, showing the electrical contacts between the electrode terminals of the electronic component, the electrical contacts of the printed circuit board and the leaf spring electrode members, in the present invention.

In the first embodiment, as shown in FIG. 6, the lengthwise dimension L1 of the obliquely extending second straight leg portion 73 is nearly double the lengthwise dimension L2 of the first straight leg portion 71. Thus, the electrical contact (hereinbelow, termed "first electrical contact portion") P1 between the first contact 8*a* and the electrode terminal 1*b* of the electronic component 1 is at an oblique angle and a second electrical contact portion P2 is established between the second contact 8*b* and the terminal 9*a* of the printed circuit board 9. A vertical line V1 which passes through the first electrical contact portion P1 is spaced a predetermined distance L3 (about 0.5 mm) in the lengthwise direction C from a vertical line V2 which passes through the second electrical contact portion P2.

Next, a method for electrically connecting the terminals 1*b* of the electronic component 1 and the terminals 9*a* of the printed circuit board 9, through the electrode members 2*a*, will be described with reference to FIG. 2, FIGS. 7A–7C and FIGS. 8A–8E. Incidentally, for brevity of description, FIGS. 7A–7C illustrate three electrode members 2*a*, and the terminals 1*b* of the electronic component 1 and the terminals 9*a* of the printed circuit board 9 which correspond to these electrode members 2*a*.

Figure 7A:
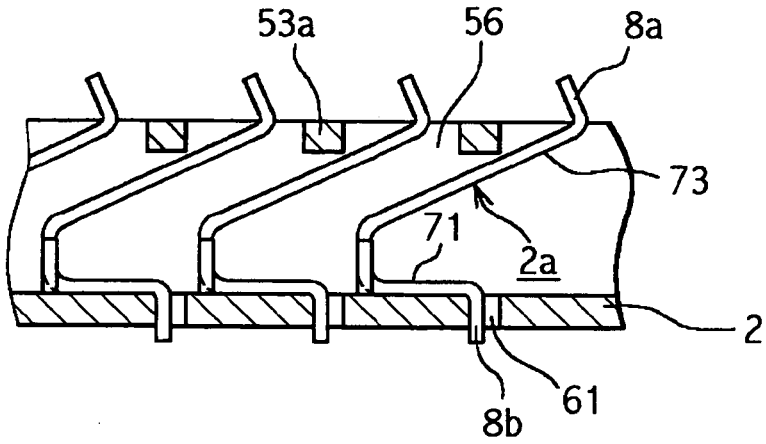
Figure 7B:
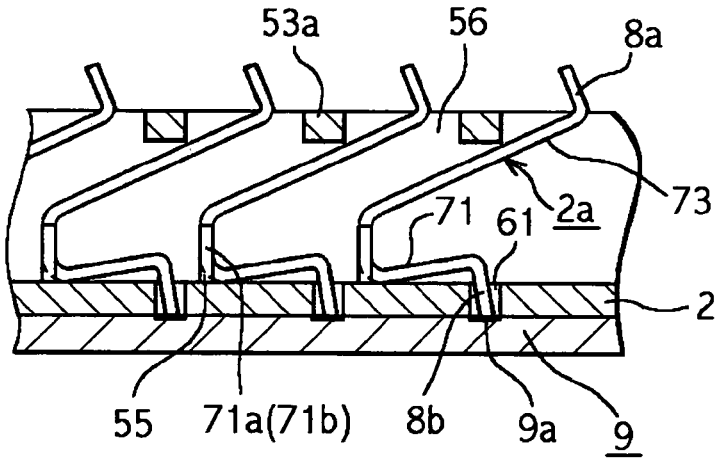

As shown in FIG. 7A, the distal end of the first contact 8*a* of each electrode member 2*a* protrudes beyond the upper surface of the body portion 2, and the distal end of the second contact 8*b* protrudes beyond the rear surface of the body portion 2. In this state, as shown in FIG. 7B, the body portion 2 is placed on the printed circuit board 9 so that the distal ends of the second contacts 8*b* of the electrode members 2*a* come into electrical contact with the corresponding terminals 9*a* of the printed circuit board 9, as the body 2 is pushed against the side of the printed circuit board 9. Then, since the pair of first engagement pieces 71*a* and 71*b* are fixed within the pair of first engagement grooves 55, the parallel extending first straight leg sections 71 of the electrode members 2*a* move slightly away from (float) the upper surface of the printed circuit board 9 while electrical contact is established between the distal ends of the second contacts 8*b* of the electrode members 2*a* and the terminals 9*a* of the printed circuit board 9.

Figure 7C:
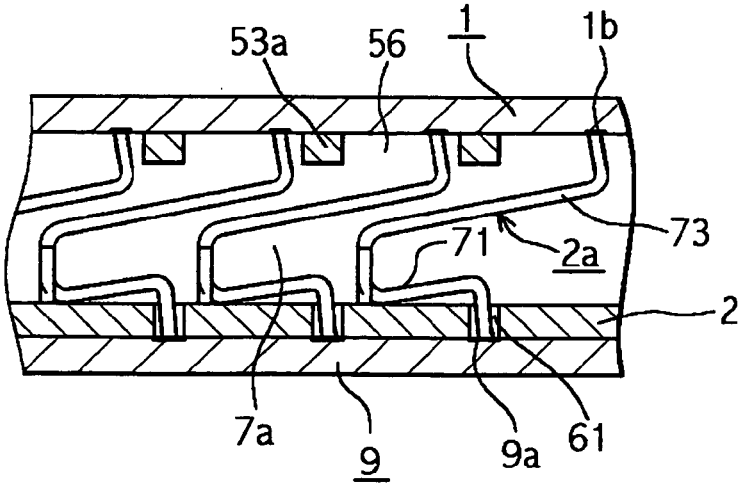
Figure 8A:
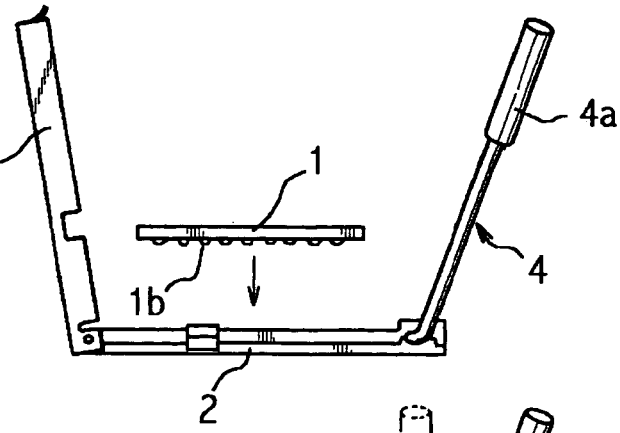
Figure 8B:
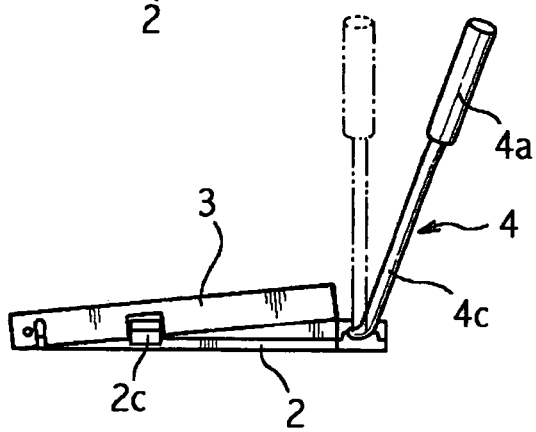
Figure 8C:
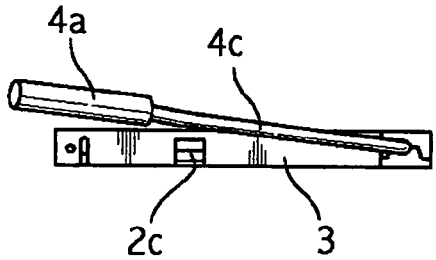
Figure 8D:
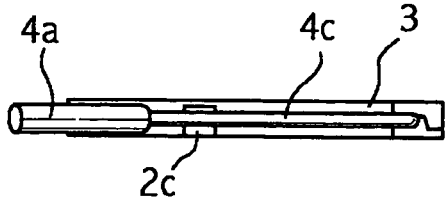
Figure 8E:
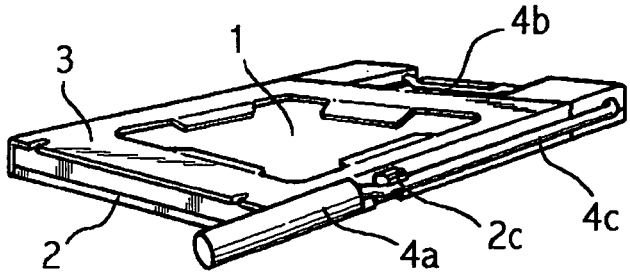

Subsequently, as shown in FIG. 8A, the electronic component 1 is received into the concave portion 2*d* (refer to FIG. 2) of the body portion 2, and the cover 3 is pivoted onto the body portion 2. Thus, as shown in FIG. 7C, the terminals 1*b* of the electronic component 1 and the distal ends of the first contacts 8*a* of the electrode members 2*a* come into electrical contact, and the electronic component 1 is lightly pressed by a first pawl 3*a* (refer to FIG. 2) which is provided in the cover 3. With the free end of the socket cover 3 pivoted toward the end edge of the body 2 (toward the right side as viewed in the figure), the grip 4*a* of the hand lever 4 is partially turned toward the other end edge of the body 2 (onto the left side as viewed in the figure) as indicated by two-dot chain lines, until a clasp member 4*b* (refer to FIG. 2) integral with the lever 4 is brought into engagement with a catch 3*e* (refer to FIG. 2) which is provided on the free end side of the cover 3. Thus, the electronic component 1 is fixed by first–fourth pawls 3*a*–3*d* (refer to FIG. 2) provided in the socket cover 3, in a state where the electrical contact between the electrode terminals 1*b* of the electronic component 1 and the distal ends of the first contacts 8*a* of the electrode member 2*a* assume the position shown in FIG. 7C. Subsequently, as shown in FIG. 8C, the grip 4*a* of the lever 4 is further turned toward the other end edge of the body 2. When the arm portion 4*c* of the lever 4 has arrived over a hook 2*e* provided on the side edge portion of the socket body 2, it is somewhat shifted laterally of the body 2. Then, as shown in FIG. 8D, the grip 4*a* is pushed further downward to bring the arm portion 4*c* into engagement with the hook 2*e*. FIG. 8E shows the state where the electronic component 1 has been completely fixed within the socket body 2.

In the above way, the first contacts 8*a* of the electrode members 2*a* are pushed into the recesses 51 of the body 2 as shown in FIG. 7C, whereby the obliquely extending second leg portions 73 of the electrode portions 2*a* are displaced toward the parallel extending first leg portions 71. That is, the openings 7*a* of the leaf spring electrode members 2*a* are narrowed, and in turn, the spring force of the second leg portions 73 toward the electronic component 1 is increased. When the electronic component 1 is detached from the body 2, the distal ends of the first contacts 8*a* will again extend beyond the upper surface of the body 2 as shown in FIG. 7B, owing to the spring forces of the obliquely extending second leg portions 73. Further, when the body 2 is detached from the printed circuit board 9, the distal ends of the second contacts 8*b* will extend to again protrude beyond the rear surface of the body 2 as shown in FIG. 7A.

A second embodiment of the present invention will now be described with reference to FIGS. 9, 10 and 11A–11C. Throughout these figures, the same reference numerals and signs are assigned to features which are the same in FIG. 3–FIG. 7C illustrating the first embodiment.

Figure 9:
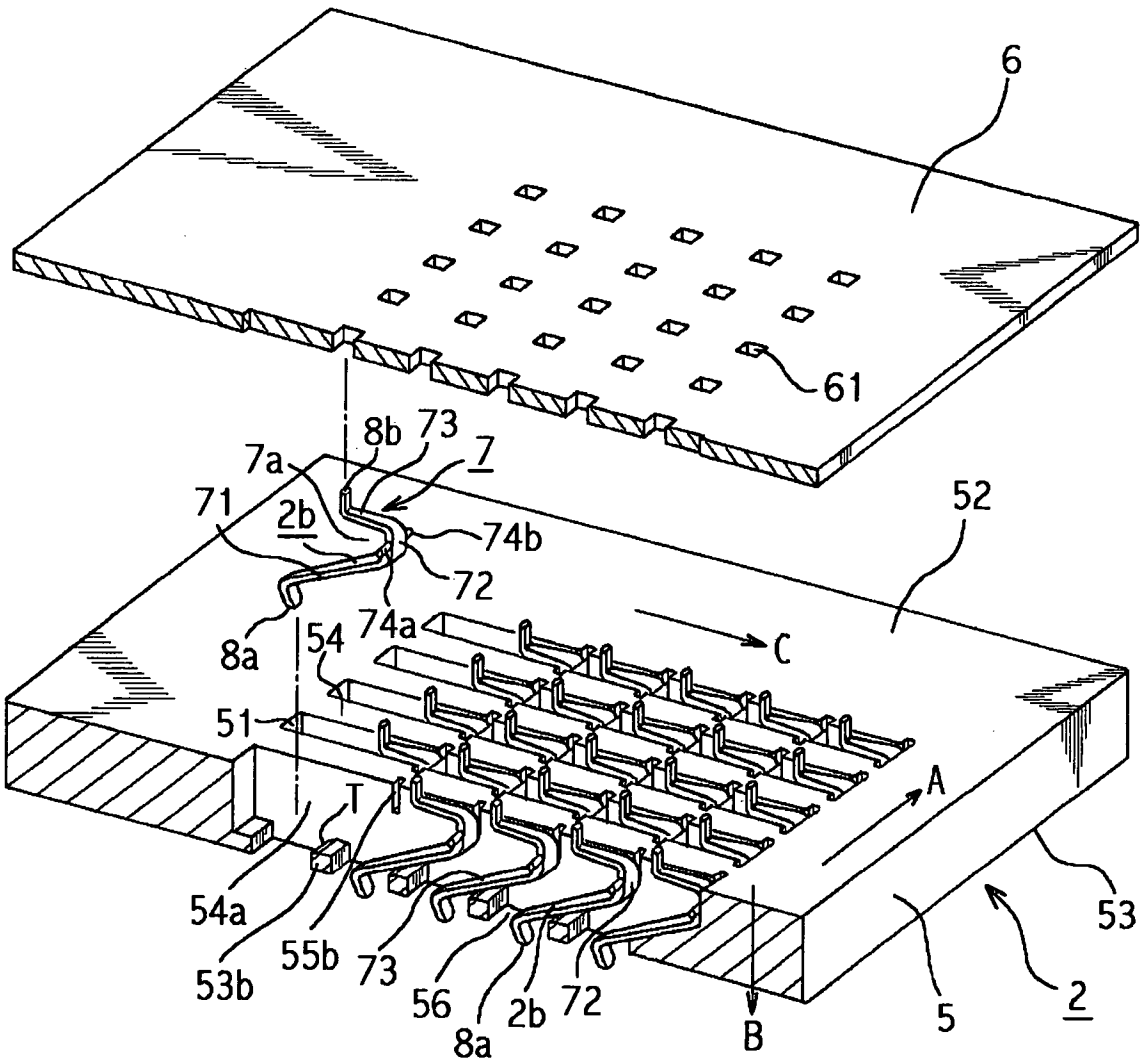
FIG. 9 is an exploded, perspective view illustrating the mounting of the electrode members in the recesses of a second embodiment of the connector board of the present invention.
Figure 10:
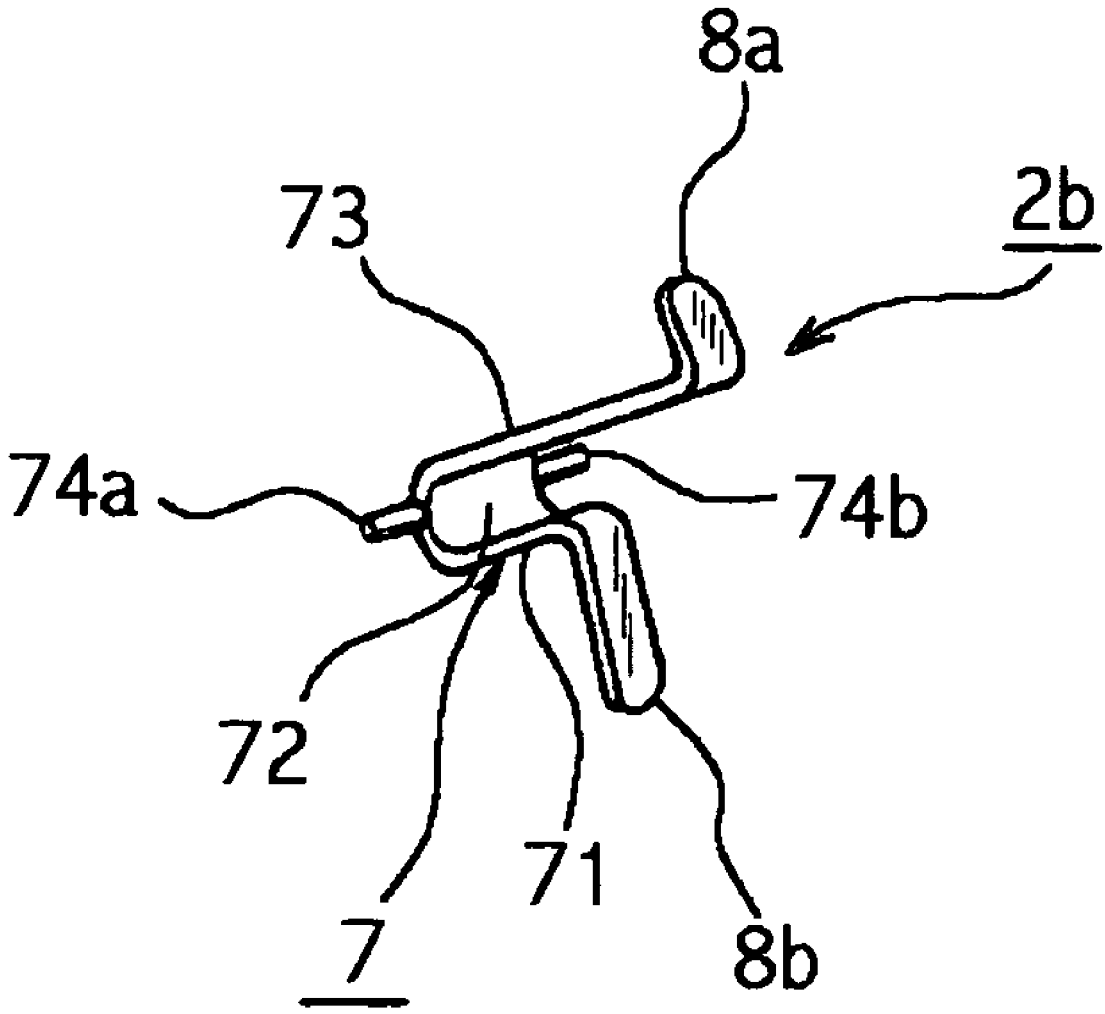
FIG. 10 is a perspective view of an electrode member of a second embodiment of the present invention.

In the second embodiment, hole surrounding portions 53*b* each have a taper T as shown in FIG. 9 and thereby differ from the hole surrounding portions 53*a* of the flat plate member 5 as shown in FIG. 3. Further, this second embodiment has electrode members 2*b* as shown in FIG. 10 instead of the electrode members 2*a* as shown in FIG. 4.

As shown in FIG. 9, an inner edge of the hole surrounding portion 53*b* of the flat plate member 5, which opposes the obliquely extending straight leg portion 73 is beveled to form a taper T which rises up obliquely from the left side toward the right side as viewed in the figure. Besides, the opposing sidewalls 54*a* of each recess 51 of the flat member 5 are provided with bearings 55*b* which are constructed similar to the first engagement grooves 55 (refer to FIG. 3). Further, shafts 74*a* and 74*b*, each of which has a diameter somewhat smaller than the width of the bearing 55*b*, are unitary with and extend from opposing sides of the coupling portion 72 of each leaf spring 7 forming the electrode member 2*b*, so as to seat within and be rotatably supported by the bearings 55*b*.

According to the second embodiment, therefore, the leaf spring 7 constituting the electrode member 2*b* is endowed with elasticity over its entire length, so that its spring force is greater than that of the electrode member 2*a* in the first embodiment.

Figure 11A:
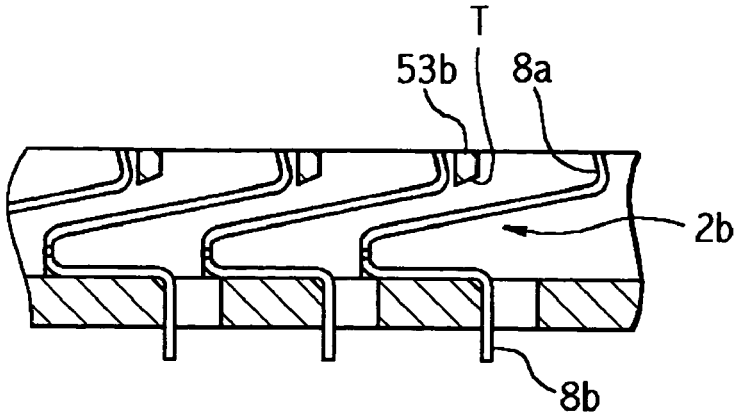
Figure 11B:
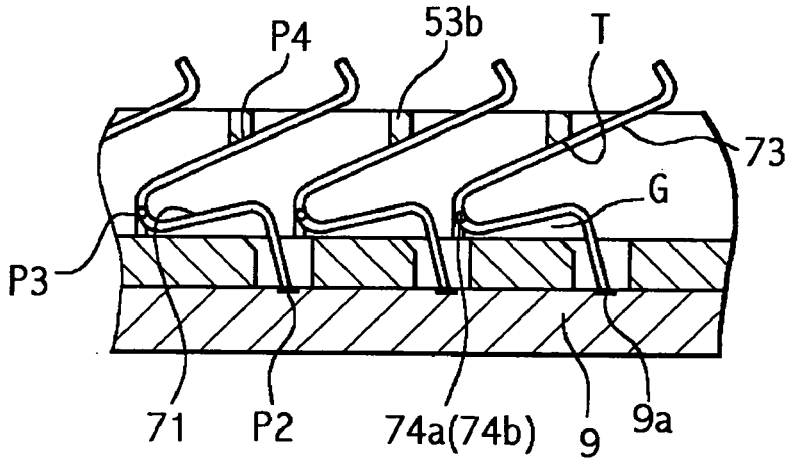

In the second embodiment, as shown in FIG. 11A, the distal ends of the first contacts 8*a* of the electrode members 2*b* do not protrude beyond the upper surface of the body 2, and only the distal ends of the second contacts 8*b* protrude beyond the rear surface of the body 2. In this state, as shown in FIG. 11B, the body 2 is placed on the printed circuit board 9 so that the distal ends of the second contacts 8*b* of the electrodes 2*b* may come into electrical contact with the terminals 9*a* of the printed circuit board 9, and the body 2 is simultaneously pushed against the side of the printed circuit board 9. Then, the obliquely extending second leg portions 73 of the electrode members 2*b* rotate, with the bearing portions P3 of the shafts 74*a* (74*b*) as fulcra, up to position P4 where these obliquely extending leg portions 73 abut against the tapered surfaces T of the hole surrounding portions 53*b*. Thus, elasticity is bestowed to each leaf spring 7 which extends from the abutment position P4 to a second electrical contact P2. In turn, the second contact 8*b* side of the parallel extending leg portion 71 of the electrode 2*b* is lifted so as to have a gap G larger than in the first embodiment. With the bearing portion P3 as the fulcrum, a state of electrical contact between the distal end of the second contact 8*b* of the electrode member 2*b* and the terminal 9*a* of the printed circuit board 9 is established and held.

Figure 11C:
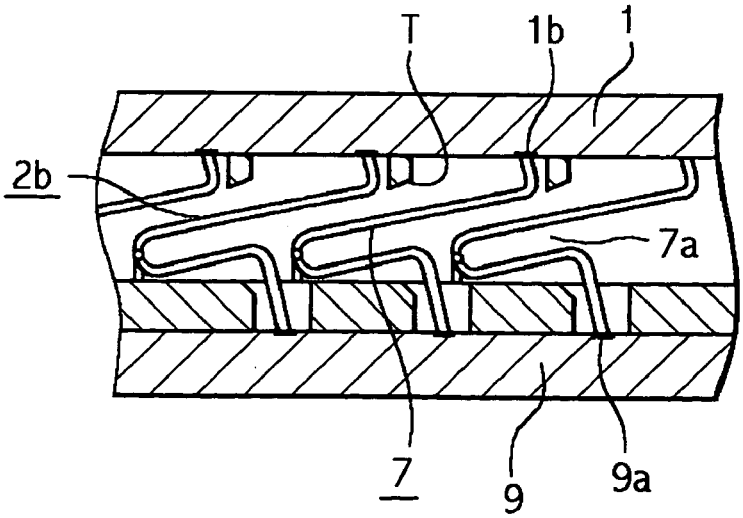

Subsequently, as in the first embodiment, the electronic component 1 is inserted into the recess 2*d* (refer to FIG. 2) of the body 2, and it is pushed toward the printed circuit board side. Then, as shown in FIG. 11C, the terminals 1*b* of the electronic component 1 and the distal ends of the first contacts 8*a* are brought into electrical contact, and the first contacts 8*a* are pushed into the recesses 51 of the body 2, whereby the obliquely extending leg portions 73 are bent toward the parallel extending portions 71. That is, the opening 7*a* of the leaf spring 7 is narrowed and, in turn, spring forces toward the side of the electronic component 1 and the side of the printed circuit board 9 derive from the whole leaf spring 7.

A third embodiment of the present invention will now be described with reference to FIGS. 12, 13 and 14A–14C. Throughout these figures, the same reference numerals and signs are assigned to features which are the same as in FIG. 3–FIG. 11C.

Figure 12:
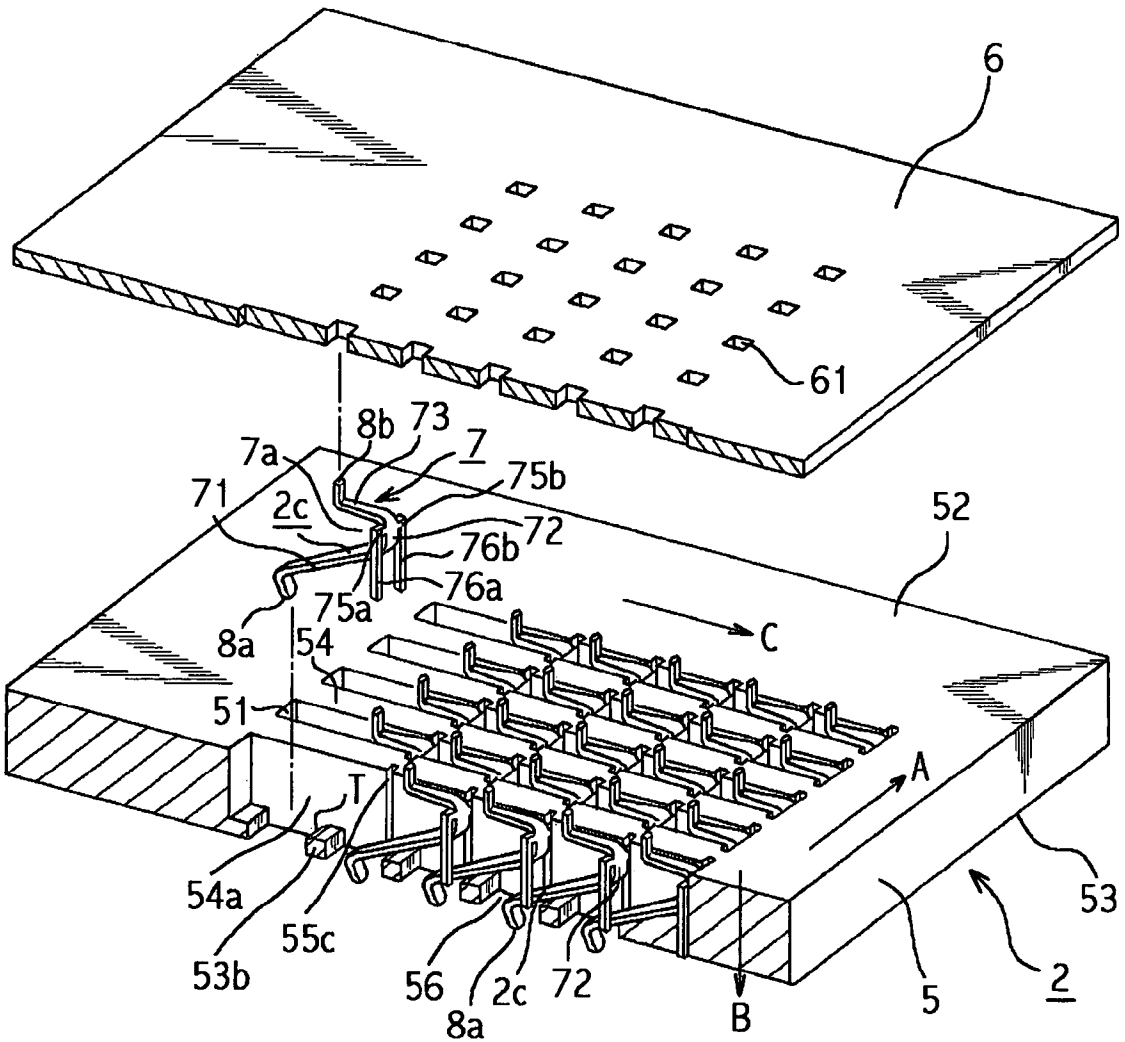
FIG. 12 is an exploded perspective view showing the mounting of electrode members in the recesses of the body of the connector board in the third embodiment of the present invention.
Figure 13:
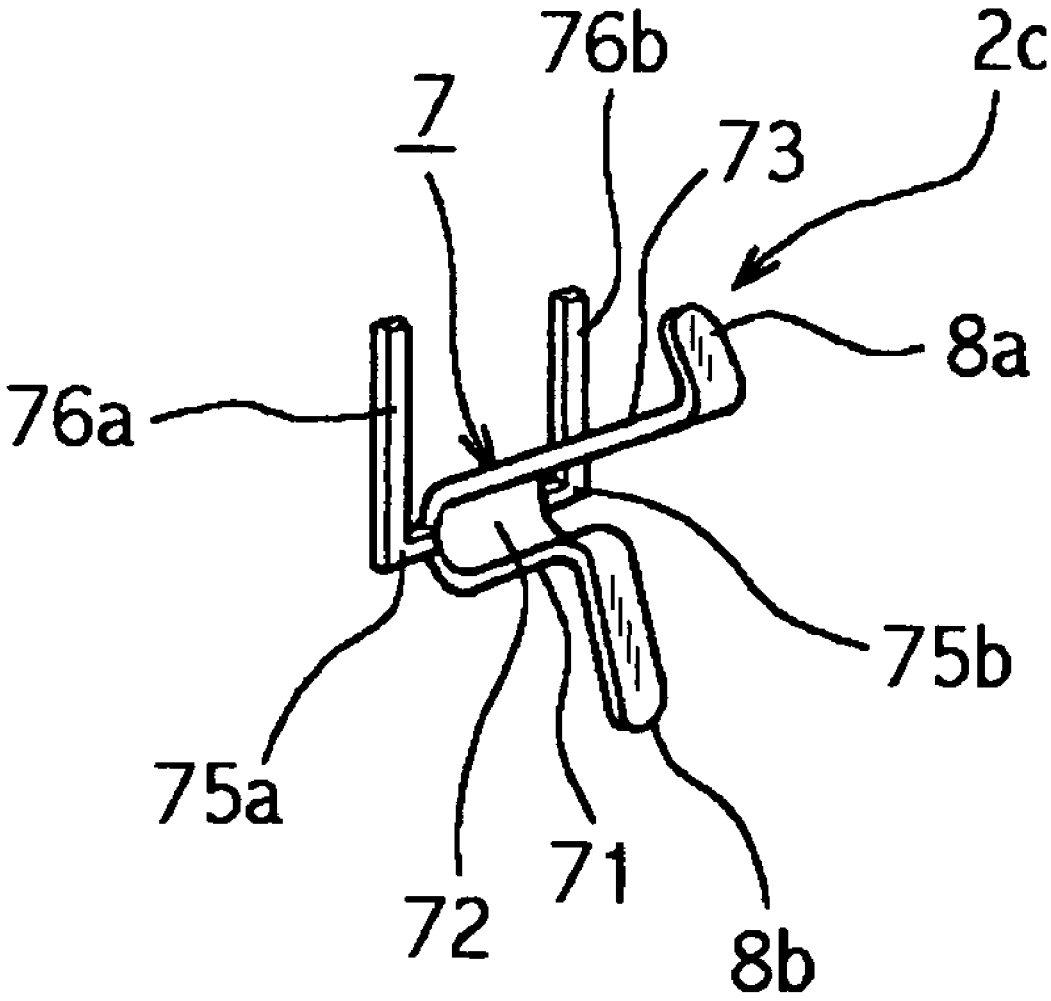
FIG. 13 is a perspective view of an electrode member of a third embodiment of the present invention.

Referring to FIG. 12, in the third embodiment hole surrounding portions 53*b* each have a taper T similar to the hole surrounding portions 53*b* of the flat plate member 5 shown in FIG. 9 but have an electrode member 2*c* as shown in FIG. 13 instead of the electrode member 2*a* shown in FIG. 4.

In the third embodiment, as shown in FIG. 12, the opposing sidewalls 54*a* of each recess 51 of the flat plate member 5 are formed with pairs of engagement grooves (hereinbelow, termed "second engagement grooves") 55*c* each of which is longer than the first engagement groove 55 (refer to FIG. 3), i.e., nearly equal to the depthwise dimension of the recess 51). As shown in FIG. 13, on both sides of the coupling portion 72 of leaf spring 7 are second engagement sections consisting of first (perpendicular) portions 75*a* and 75*b* which are formed unitarily with the coupling portion 72 and second portions 76*a* and 76*b* which are formed unitarily with and at right angle to the first portions 75*a* and 75*b* at the distal ends thereof. Thus, second portions 76*a* and 76*b* extend in parallel with the sidewalls 54*a*.

In the electrode 2*c*, the pair of second portions 76*a* and 76*b* of the engagement elements are respectively seated within the corresponding second engagement grooves 55*c*. According to the third embodiment, therefore, the leaf spring 7 constituting the electrode member 2*c* derives elasticity over its entire length, and the second engagement pieces 76*a* and 76*b* are subjected to torsional forces, so that the spring force of the electrode member 2*c* against an electronic component and a printed circuit board is greater than in the second embodiment.

Figure 14A:
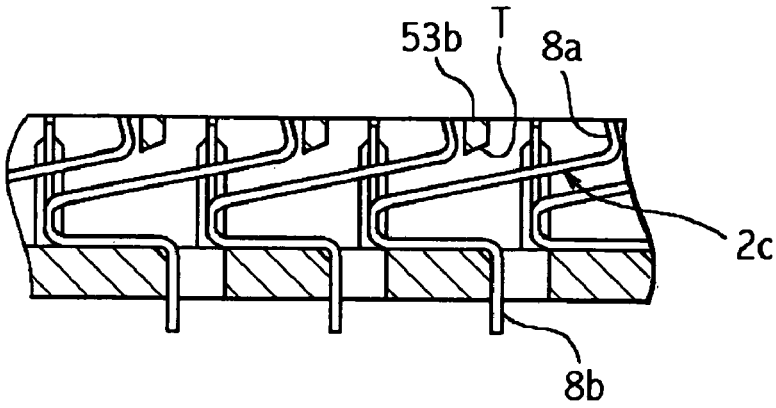
Figure 14B:
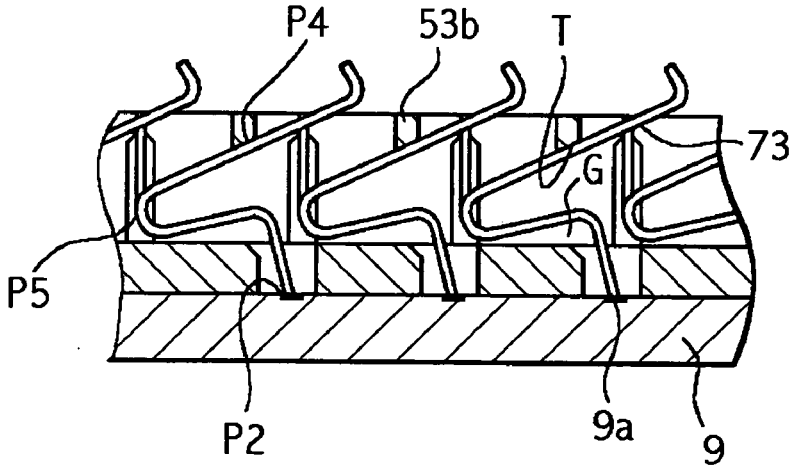

In the third embodiment, as shown in FIG. 14A, the distal ends of the first contacts 8*a* do not protrude beyond the upper surface of body 2, and only the distal ends of the second contacts 8*b* protrude beyond the rear surface of the body 2. As shown in FIG. 14B, the body 2 is placed on the printed circuit board 9 so that the distal ends of the second contacts 8*b* come into electrical contact with the terminals 9*a* of the printed circuit board 9, and the body 2 is simultaneously pushed against the side of the printed circuit board 9. Then, the obliquely extending (second) leg portions 73 rotate, with the portions P5 of the second engagement elements 76*a* (76*b*) as fulcra, up to position P4 where these obliquely extending leg portions 73 abut against the tapered surfaces T of the hole surrounding portions 53*b*. Thus, elasticity of each leaf spring 7 extends from the abutment P4 to a second electrical contact P2. In turn, the parallel extending leg portion 71 is lifted to form a gap G larger than that of the first embodiment. With the engagement portion P5 as the fulcrum, the electrical contact between the distal end of the second contact 8*b* and the terminal 9*a* of the printed circuit board 9 is maintained.

Figure 14C:
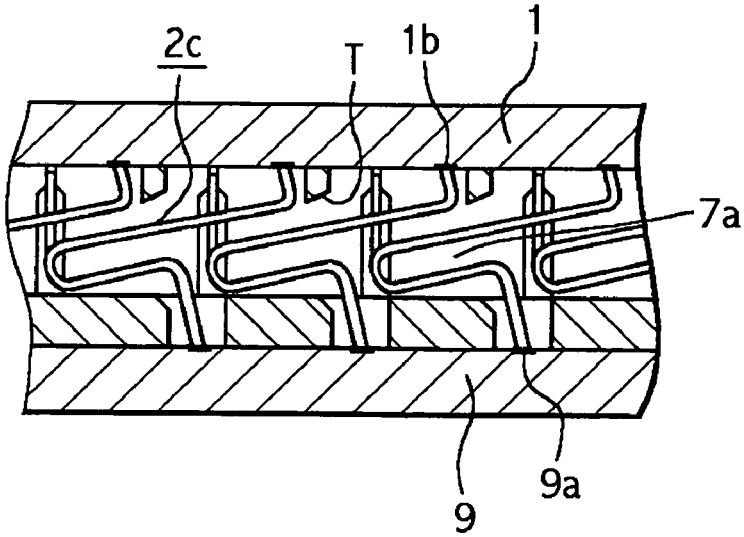
Figure 15:
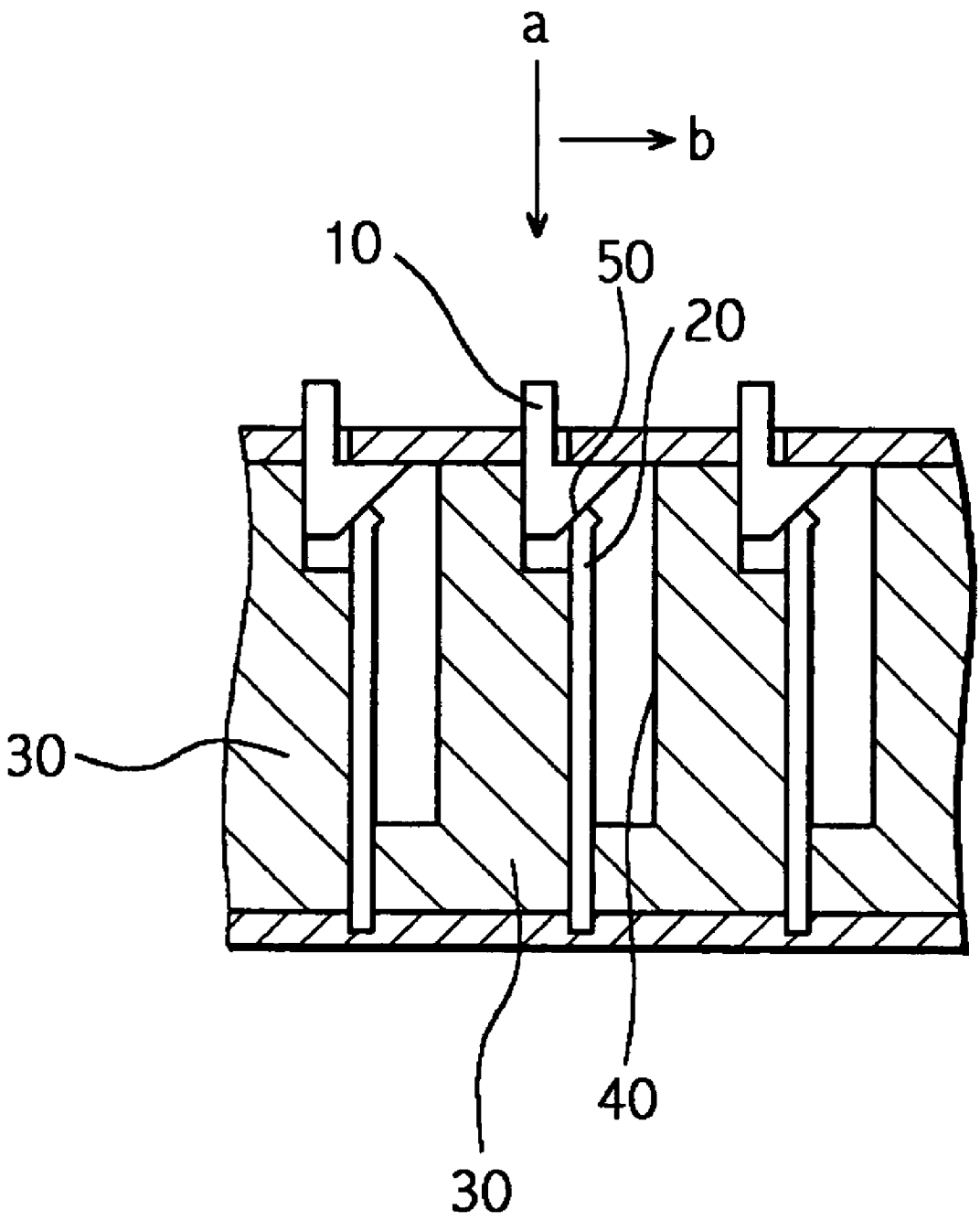
FIG. 15 is a fragmentary sectional view of a prior art connector board.

Subsequently, as in the first embodiment, the electronic component 1 is inserted into the recess 2*d* (refer to FIG. 2) of the socket body 2, and it is pushed toward the printed circuit board side. Then, as shown in FIG. 14C, the terminals 1*b* of the electronic component 1 and the distal ends of the first contacts 8*a* of electrodes 2*c* are brought into electrical contact, and the first contacts 8*a* are pushed back into the recesses 51 of the body 2, whereby the obliquely extending leg portions 73 are displaced toward the parallel extending leg portions 71. That is, the opening 7*a* of the leaf spring 7 is narrowed and, in turn, the spring forces toward the side of the electronic component 1 and the side of the printed circuit board 9 derive from the whole leaf spring 7.

In each of the foregoing embodiments, the terminals 1*b* of the electronic component 1 are held in electrical contact with the first contacts 8*a*, and the second contacts 8*b* are held in electrical contact with the terminals 9*a* of the printed circuit board 9, but it is also possible to hold the terminals 9*a* of the printed circuit board 9 in electrical contact with the first contacts 8*a*, and to hold the second contacts 8*b* in electrical contact with the terminals 1*b* of the electronic component 1. Moreover, the electronic component 1 is not restricted to a BGA, but it may also be, for example, an LGA (Land Grid Array), a CSP (Chip Size Package), a PGA (Pin Grid Array) or a micro PGA.

As understood from the above description, according to the present invention, each electrode member has a simple, single-piece construction, so that the workability and assembly of the electrode member is sharply enhanced, and the cost thereof becomes comparatively low. Moreover, the electrical contact between each first contact and the corresponding electrode terminal of the electronic component (or a printed circuit board) is at an oblique angle, so that the leaf spring can be lengthened. In turn, even when the thickness of the body of the connector board is small, each terminal of the electronic component and the corresponding terminal of the printed circuit board can be reliably brought into electrical contact, with a stable pressure.

What is claimed is:

1. A connector board for electrically connecting electrode terminals of an electronic component with electrode terminals of a printed circuit board, said connector board comprising:

an insulating plate having opposing surfaces extending in longitudinal and lateral dimensions and having recesses, each of said recesses defined by opposing parallel side walls defining therebetween an opening at one of said opposing surfaces and extending from said opening toward the other of said opposing surfaces; and leaf spring electrode members mounted in said recesses and formed of a conductive plate having opposing parallel surfaces extending across major and minor dimensions, said conductive plate having distal bends across said minor dimension adjacent both of distal ends forming distal contact sections and an intermediate bend across said minor dimension intermediate said distal bends, each of said electrode members including, as an integral structure, a coupling section at said intermediate bend and first and second straight leg sections extending from said coupling section to said distal bends, said distal contact sections extending from said straight leg sections, to which said distal contact sections are appended at said distal bends, outwardly of insulating plate with said distal contact sections respectively extending from and beyond respective opposing surfaces of said insulating pate, whereby placement of a circuit board or electrical component against the opposing surfaces of said insulating plate displaces the distal contact sections inwardly into said recesses against the spring forces of the leaf spring electrode member; and wherein said recesses are elongated slots extending along the longitudinal dimension and are arrayed in parallel across the lateral dimension and wherein a plurality of said leaf spring electrode members are respectively mounted, spaced apart, in each of said elongated slots, said parallel side walls of each elongated slot extending from said opening to a bottom having apertures therein through which extend the distal contact sections appended to said first straight leg sections; and wherein the connector board further comprises an insulating plate-like lining member covering said one opposing surface and having apertures therein through which extend the distal contact sections appended to said second straight leg sections.

2. A connector board according to claim 1 wherein said distal contact sections extend from said straight leg section, at said distal bends, substantially perpendicular to said straight leg sections.

3. A connector board according to claim 1 further comprising:

pairs of parallel grooves respectively formed in the opposing side walls of the recesses, each of said grooves opening at said one opposing surface and extending toward the other of said opposing surfaces; and engagement sections unitary with and extending from opposing sides of said coupling section, said engagement sections being respectively fitted within a pair of said parallel grooves.

4. A connector board according to claim 1 wherein said first straight leg sections extend substantially in parallel with said opposing surfaces of said insulating plate and said second straight leg sections extend from said intermediate bend obliquely relative to said opposing surfaces of said insulating plate.

5. A connector board according to claim 4 wherein the obliquely extending straight leg section is longer than the parallel extending straight leg section.

6. A connector board according to claim 5 wherein the obliquely extending straight leg section has a length nearly double the length of the parallel extending straight leg section.

7. A connector board according to claim 5 wherein each of said leaf spring electrode members has its distal contact sections spaced apart by a predetermined distance extending along said longitudinal dimension.

8. A connector board according to claim 1 further comprising:

pairs of parallel grooves respectively formed in the opposing side walls of the recesses, each of said grooves opening at said one opposing surface and extending toward the other of said opposing surfaces; and engagement sections unitary with and extending from opposing sides of said coupling section, said engagement sections being respectively fitted within a pair of said parallel grooves.

9. A connector board according to claim 8 wherein said engagement sections are shafts rotatably supported within a pair of said parallel grooves.

10. A connector board according to claim 8 wherein said engagement sections each include a first portion extending perpendicular to said opposing side walls of said recesses and a second portion, parallel to and fitted within one of said parallel grooves, said second portion extending from a distal end of said first portion, perpendicular to said first portion.

11. A connector board according to claim 8 wherein each of said engagement sections is a plate section with opposing surfaces in parallel with the groove in which the plate section is fitted.

* * * * *

UNITED STATES PATENT AND TRADEMARK OFFICE

CERTIFICATE OF CORRECTION

PATENT NO. : 7,083,424 B2
APPLICATION NO. : 10/862357
DATED : August 1, 2006
INVENTOR(S) : Sentaro Motohashi It is certified that error appears in the above-identified patent and that said Letters Patent is hereby corrected as shown below:

Column 10, line 65, (claim 2, line 2 ), “leg section” should read -- leg sections --.

Signed and Sealed this

Twenty-sixth Day of December, 2006

JON W. DUDAS
*Director of the United States Patent and Trademark Office*